US007183876B2

(12) United States Patent
Fallon et al.

(10) Patent No.: US 7,183,876 B2
(45) Date of Patent: Feb. 27, 2007

(54) VARIABLE COUPLING FACTOR DIRECTIONAL COUPLER

(75) Inventors: Dan Fallon, Durham, ME (US); Kerry Phelps, South Paris, ME (US)

(73) Assignee: Electronics Research, Inc., Chandler, IN (US)

( * ) Notice: Subject to any disclaimer, the term of this patent is extended or adjusted under 35 U.S.C. 154(b) by 147 days.

(21) Appl. No.: 10/249,392

(22) Filed: Apr. 4, 2003

(65) Prior Publication Data

US 2004/0196115 A1 Oct. 7, 2004

(51) Int. Cl.
*H01P 5/12* (2006.01)

(52) U.S. Cl. ..... 333/111; 333/109

(58) Field of Classification Search ..... 333/109, 333/111, 116, 115

See application file for complete search history.

(56) References Cited

U.S. PATENT DOCUMENTS

| | | | | |
|---|---|---|---|---|
| 2,562,281 | A | 7/1951 | Mumford | |
| 2,657,361 | A | 10/1953 | Henning | |
| 2,679,632 | A | 5/1954 | Bellows, Jr. | |
| 3,166,723 | A | 1/1965 | Bock et al. | |
| 4,001,730 | A | 1/1977 | Spinner | |
| 4,333,062 | A * | 6/1982 | Uwano | 331/99 |
| 4,349,793 | A | 9/1982 | Spinner | |
| 4,754,241 | A | 6/1988 | Spinner | |
| 5,047,737 | A | 9/1991 | Oldfield | |
| 5,307,030 | A * | 4/1994 | King et al. | 333/24 R |
| 5,347,244 | A | 9/1994 | Monti | |
| 5,926,076 | A * | 7/1999 | Johnson et al. | 333/109 |

OTHER PUBLICATIONS

N. Benahmed & M. Feham, Rigourous Analytical Expressions for Electromagnetic Parameters of Transmission Lines: Coupled Sliced Coaxial Cable, www.mwjournal.com—Microwave Journal, Nov. 2001, USA.

* cited by examiner

*Primary Examiner*—Timothy P. Callahan
*Assistant Examiner*—Cassandra Cox
(74) *Attorney, Agent, or Firm*—C. Richard Martin

(57) ABSTRACT

A variable coupling factor directional coupler having a variable aperture positioned between a transmission line section and a coupling conductor connected at either end to a center conductor of a pair of connectors. The coupling factor of an RF signal in the transmission line section to the coupling conductor may be adjusted by linear movement of a gap plate to open or close the aperture. Alternatively, the coupling conductor may be located within a slotted tube. As the slotted tube is rotated, the slotted portion of the tube opens or closes the aperture. The position of the inner conductor of the coupling conductor with respect to a grounded sidewall can be adjusted to change the coupled line impedance in order to optimize the coupler directivity.

22 Claims, 7 Drawing Sheets

VARIABLE COUPLING FACTOR DIRECTIONAL COUPLER

BACKGROUND OF INVENTION

1. Field of the Invention

This invention relates to directional couplers. More particularly, the invention is concerned with a cost efficient directional coupler having a variable coupling factor.

2. Description of Related Art

Directional couplers are useful for sampling and or measuring RF energy. The directional characteristic of directional couplers allows separate measurement and or sampling of the forward and reflected components of RF energy traveling along, for example, a coaxial cable. The coupling factor is a measure of how much of the total RF energy present in a main cable is coupled to an auxiliary cable, the remainder continuing along the main cable. Variable coupling factor functionality allows the level of sampling and or measurement to be adjusted.

Mathematical models for the electrical interaction between coupled lines of unequal cross section and coupled coaxial lines in particular are well known to those skilled in the art. Also, factors influencing directivity in a directional coupler are known.

Common for usage in high power RF systems are directional couplers with loose coupling values (30–50 dB) between a main power carrying line of large size (1⅝" EIA to 8³⁄₁₆" or waveguide) and a small size coupled line feeding a monitor or feedback circuit (interconnected using, for example, type N or TNC connectors).

Couplers implemented with a variable rather than fixed coupling factor have some advantages over fixed coupling factor couplers. For example, they can serve as a flexible test instrument and be field set for specific applications. They are also useful in high power low VSWR systems where monitoring forward power requires a low coupling factor in order to protect the detector but also a higher coupling factor to detect a typically much lower reflected power. They are also useful in a production environment where a single assembly can be stocked and rapidly adjusted to a range of desired coupling factors.

The typical approach for loosely coupled mechanically adjustable directional couplers is to use an electrically short (less than one quarter wavelength) coupled line whose proximity to the main line can be varied. By moving the coupled line closer to the main line the coupling is increased and by moving it farther away the coupling is decreased. The directivity of the coupler is then optimized for specific coupling values by rotating the coupled lines orientation with respect to the mainline. Orientations of 30° to 60° are typical. This design approach requires a coupled line assembly with two mechanical degrees of freedom (proximity and rotation) with respect to the mainline. The cost of manufacture of such an assembly may be relatively expensive. The fact that the coupled line is electrically short means that the coupling value is not flat over a broad frequency range, generally falling off at 6 dB per octave.

Competition within the coupler industry has focused attention on reduction of coupler materials and manufacturing costs.

Therefore, it is an object of the invention to provide an apparatus that overcomes deficiencies in the prior art.

BRIEF DESCRIPTION OF DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION

Figure 11A:
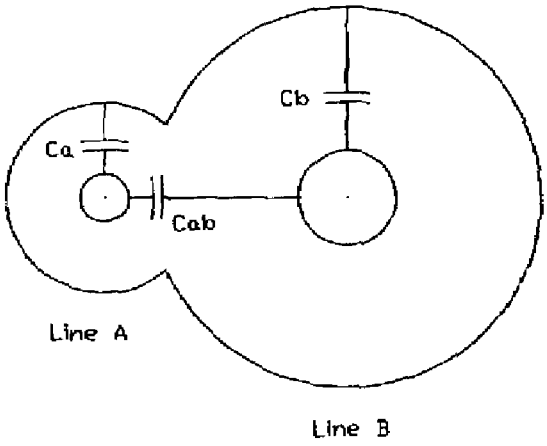
FIG. 11*a* is a schematic cross section of two coaxial lines coupled through an aperture with three capacitances identified.
Figure 11B:
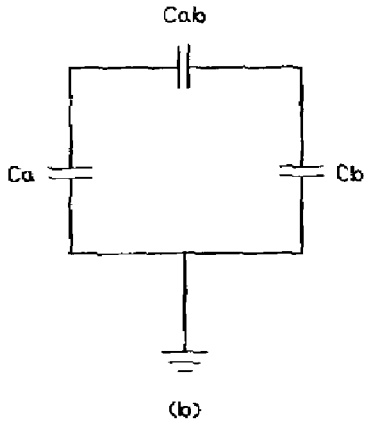
FIG. 11*b* is an equivalent circuit representation of the structure shown in FIG. 11*a*.

Referring to FIGS. 11*a* and 11*b*, a preliminary description of the electrical characteristics of coaxial lines coupled through an aperture follows. "Ca" is the capacitance per unit length of the inner conductor of Line A coupled to ground. "Cb" is the capacitance per unit length between the inner conductor of Line B coupled to ground. "Cab" is the capacitance per unit length between the inner conductors of Line A and Line B.

For practical couplers in high power systems, if Line B is the main line, "Cb" is fixed by the characteristic impedance thereof. This value is therefore preferably left unchanged in the coupler design. As shown by the equivalent circuit representation of FIG. 11*b*, the coupling between the lines is proportional to "Cab". Also, from coupled coaxial line electrical theory, the size of the aperture between the lines is directly proportional to "Cab". The match and directivity of the coupler are complex functions of all three variables. If "Cb" is fixed and "Cab" is used to set the coupling factor, then "Ca" may be adjusted to optimize the coupler match and directivity.

For purposes of illustration, a first embodiment of the invention is shown in FIGS. 1–7. In the first embodiment, the variable coupling factor directional coupler (VCFDC) 1 is configured for placement in-line with a 1⅝ inch coaxial transmission *line*. A*lternatively*, the VCFDC 1 may be dimensioned for use with a coaxial transmission line of any *diameter*, for example ¼ to 8³⁄₁₆ inch diameter coaxial transmission line, cable or waveguide. In the first embodiment, each end 5 is shown configured for NF type connection. Alternatively, any form of connection, for example EIA flanges or other form of coaxial connector, may also be used.

The end(s) 5 are mounted to a body 10, having a center bore through which a center conductor 15 coaxially passes. The center conductor 15 may be supported by a dielectric or free, held in a coaxial orientation with respect to the end(s) 5 and the body 10 by the NF or other form of connection that links the VCFDC 1 in-line with a transmission line coupled to either end 5 of the VCFDC 1.

Figure 1:
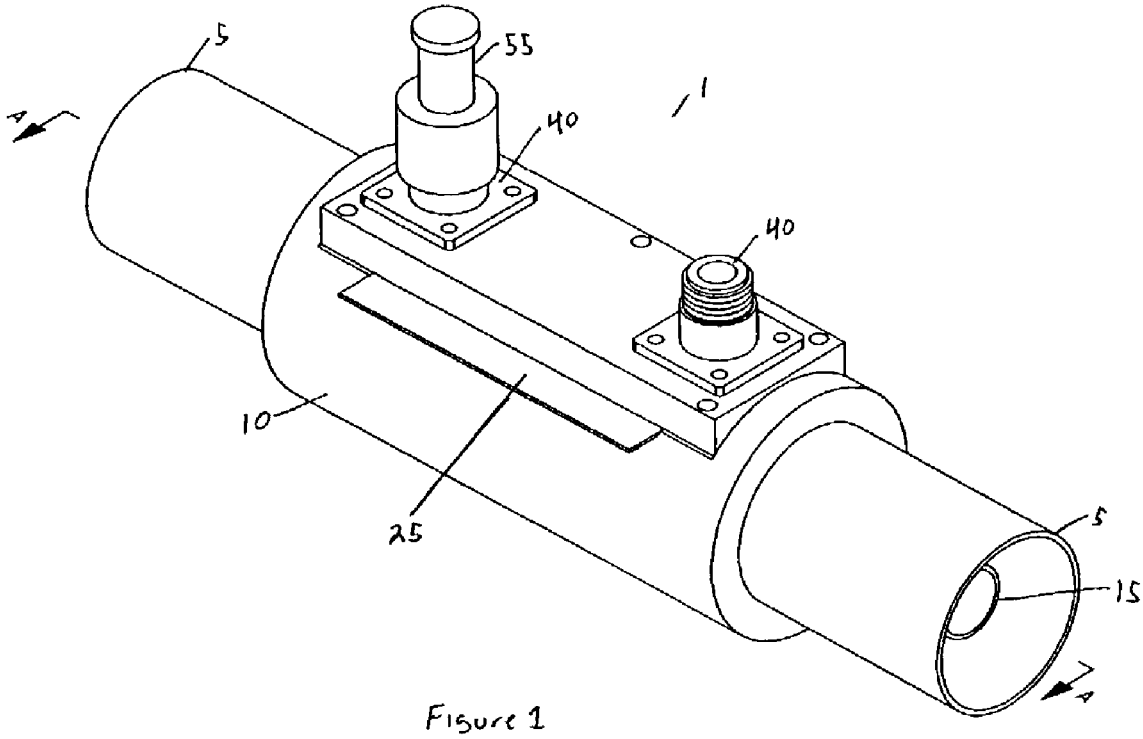
FIG. 1 is an external isometric view showing a first embodiment of the invention.
Figure 2:
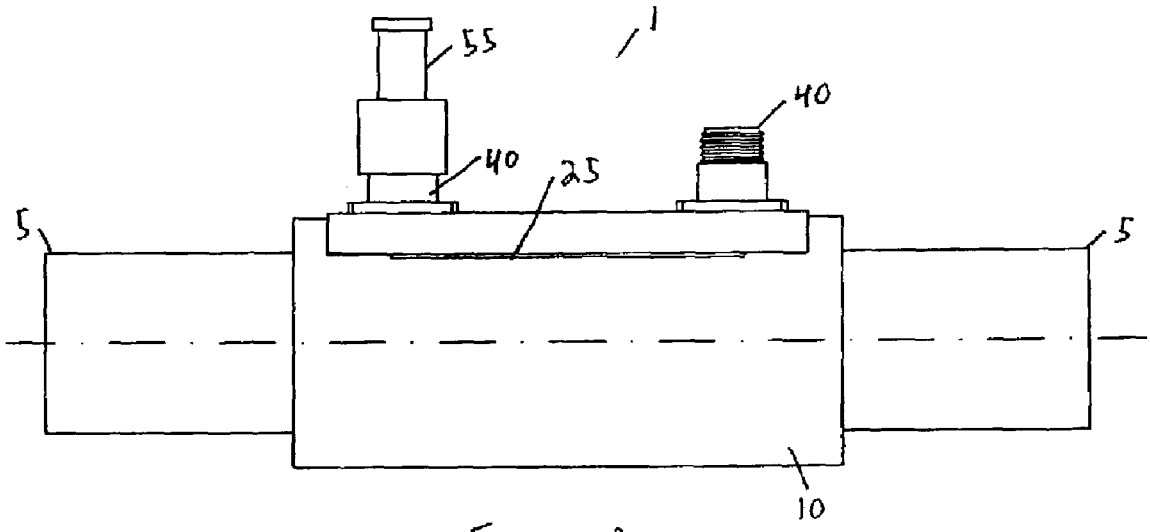
FIG. 2 is an external side view of the embodiment of FIG. 1.
Figure 3:
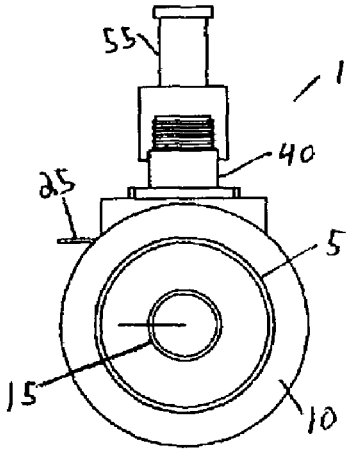
FIG. 3 is an external end view of the embodiment of FIG. 1.
Figure 4:
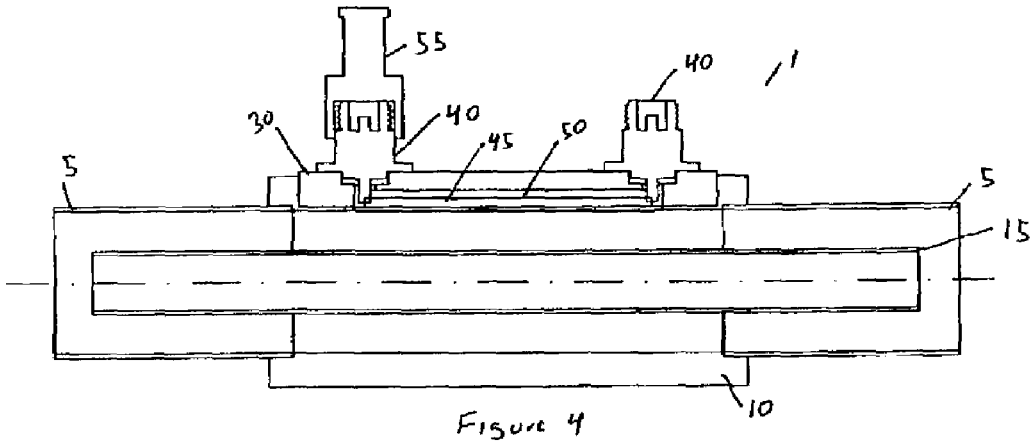
FIG. 4 is a cut-away side view along the line AA of the embodiment shown in FIG. 1.
Figure 5:
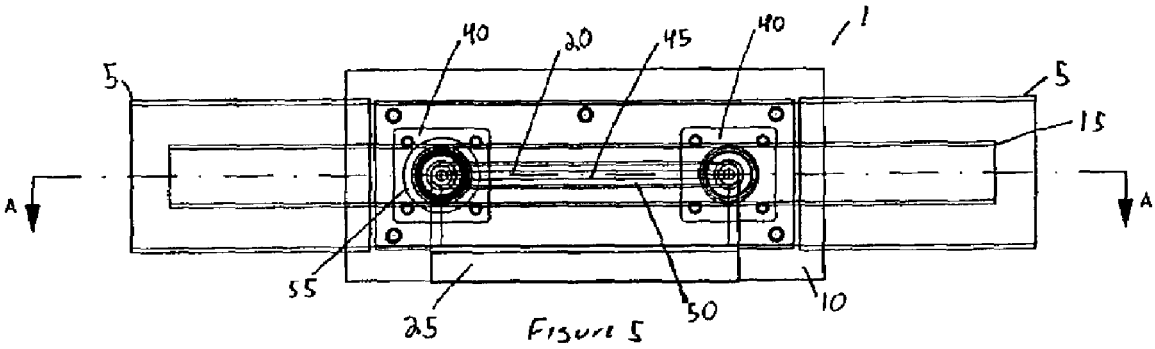
FIG. 5 is a top view, showing hidden lines, of the embodiment of FIG. 1.
Figure 6:
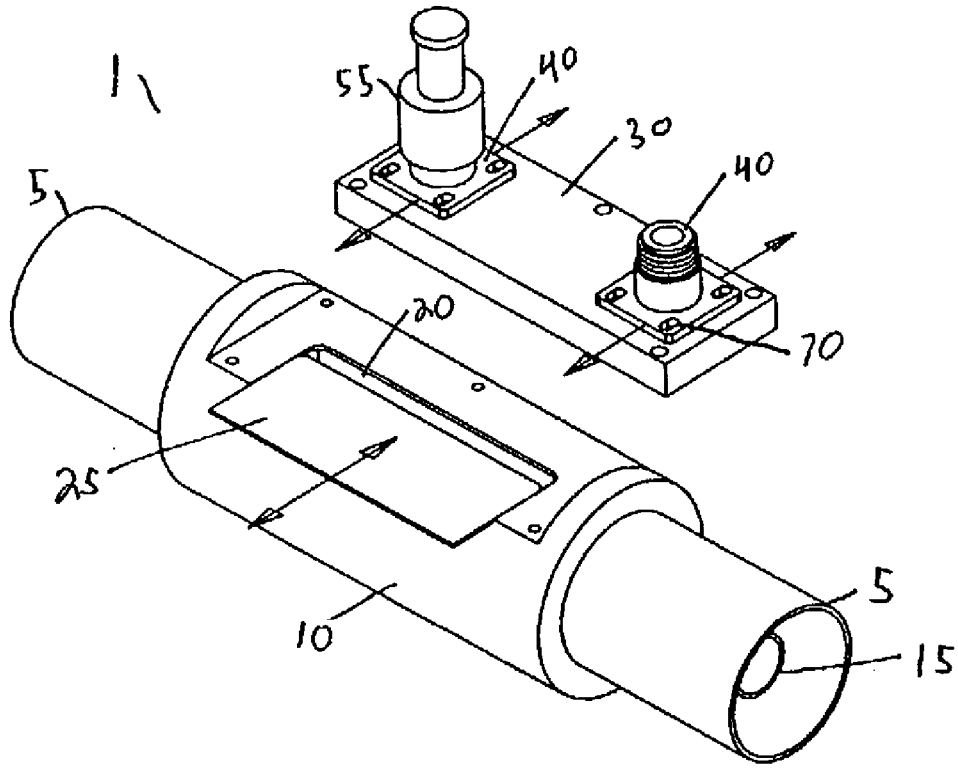
FIG. 6 is an exploded isometric view, from above, of the embodiment of FIGURE 1.
Figure 7:
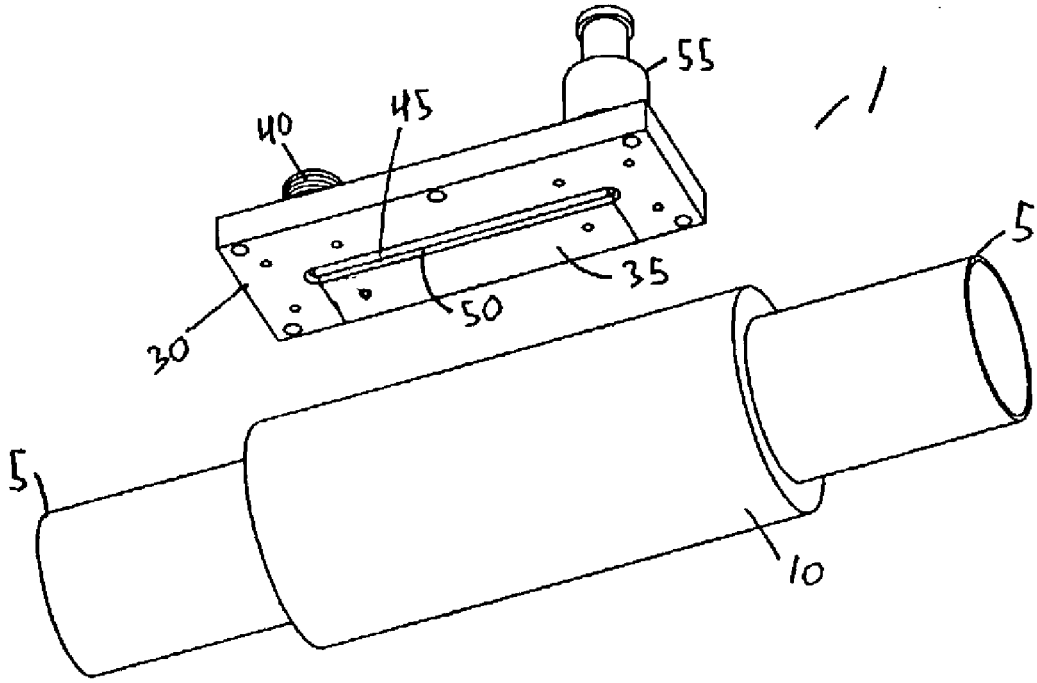
FIG. 7 is an exploded isometric view, from below, of the embodiment of FIG. 1.

The body 10 has a mounting surface with an aperture 20 that extends through the body 10 to the dielectric space and the center conductor 15. A connection plate 30 mates to the mounting surface, covering the aperture 20. A groove 35 (FIG. 7) on the underside of the connection plate 30 is adapted to retain a gap plate 25 that is slidable (as shown in FIG. 6) within the groove 35 to open or close the aperture 20 as desired. Alternatively, the groove 35 may be formed in the body 10.

A pair of connectors 40, for example type N coaxial connectors, are mounted on a top side of the connection plate 30. A slot 50, aligned with the aperture 20, formed on the under side of the connection plate 30 extends between the connectors 40. The center conductors of each connector 40 are connected to either end of a coupling conductor 45 that extends between the connector(s) 40 in the slot 50, spaced away from the sidewalls of the slot 50.

When the VCFDC 1 is connected in-line with a transmission line, RF signals propagating along the transmission line in the form of electric and or magnetic fields radiate through the aperture 20 and couple with the coupling conductor 45. As the aperture 20 is opened or closed by manipulating the gap plate 25, the electric and or magnetic fields are variably exposed to or isolated from the coupling conductor 45, allowing adjustment of the coupling to a desired coupling factor. With the aperture 20 completely open the VCFDC 1 has a maximum coupling value. When the gap plate 25 is used to close off the aperture 20, the coupling factor is reduced. The maximum coupling factor is determined by the length of the slot (one quarter wavelength or odd multiple thereof for maximum coupling), the proximity of the conductors, the width of the slot and the width of the coupling conductor 45.

When a load 55 is attached to one of the connectors 40, the coupling becomes directional, allowing separate measurement of forward and reflected signals. Exchanging the load 55 to the other connector 40 is a simple and fast way of changing the direction of coupling. Therefore, the VCFDC 1 is useful, for example, when calculating VSWR. The connectors 40 have oversized mounting holes in the form of connector slot(s) 70. When the fasteners (not shown) used to mount the connectors 40 are loosened the assembly consisting of the connectors 40 and coupling conductor 45 can be moved laterally within the slot 50. By adjusting the coupling conductors 45 position relative to the sidewall of the slot 50 the value "Ca" is increased or decreased. Using this adjustment the directivity of the coupler may be optimized.

Figure 8:
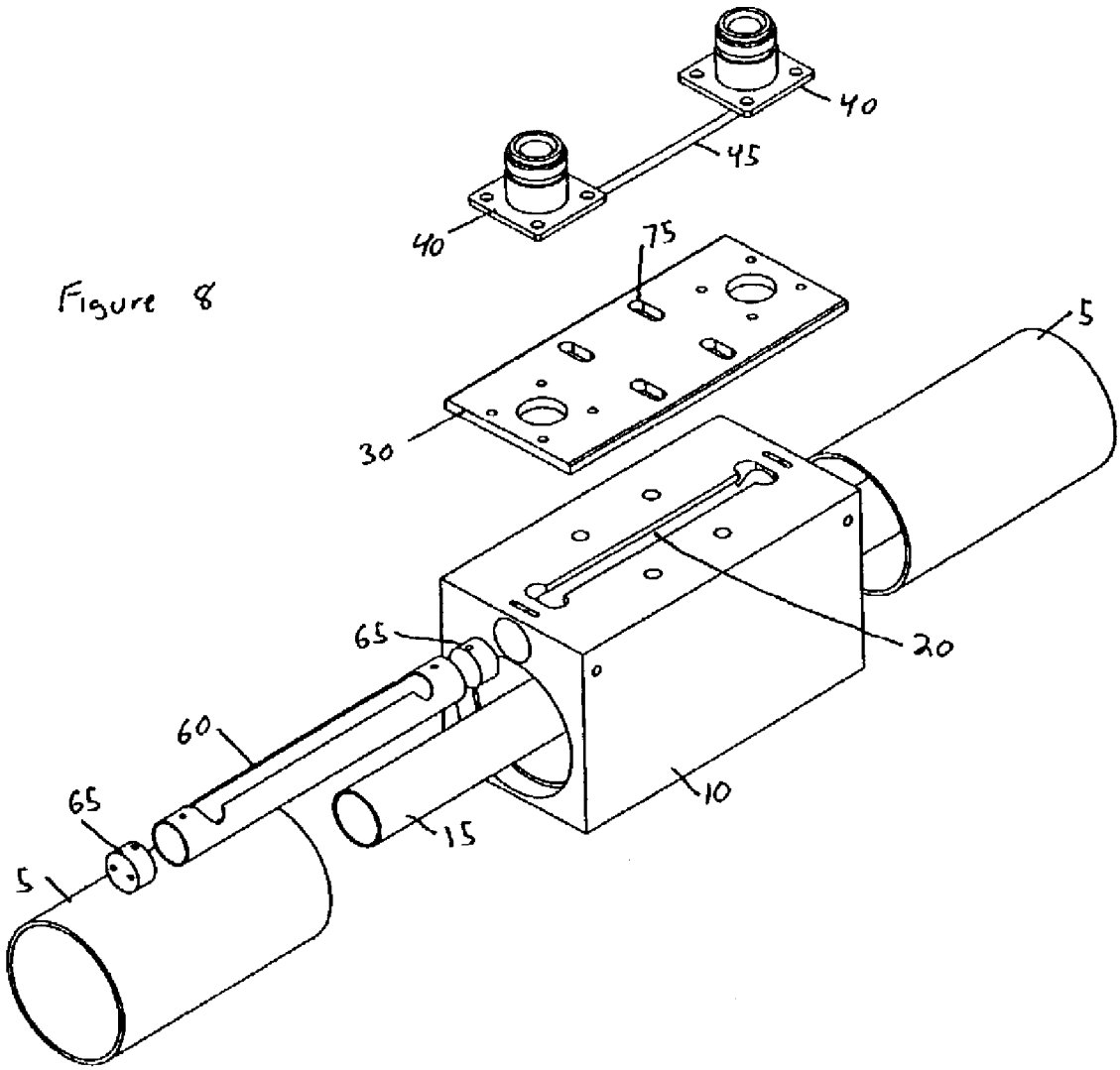
FIG. 8 is an exploded isometric view of a second embodiment of the invention.
Figure 9:
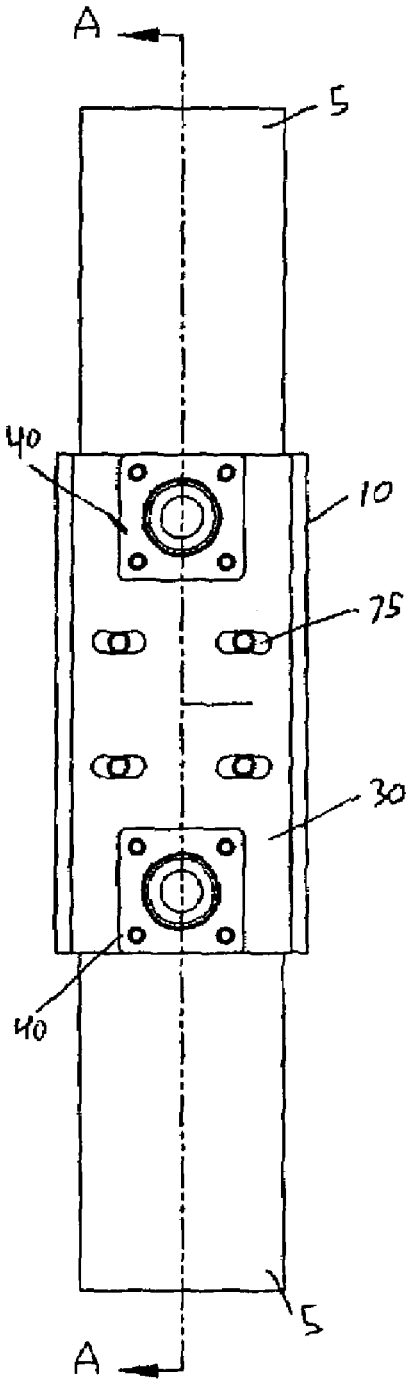
FIG. 9 is an external top view of the embodiment of FIG. 8.
Figure 10:
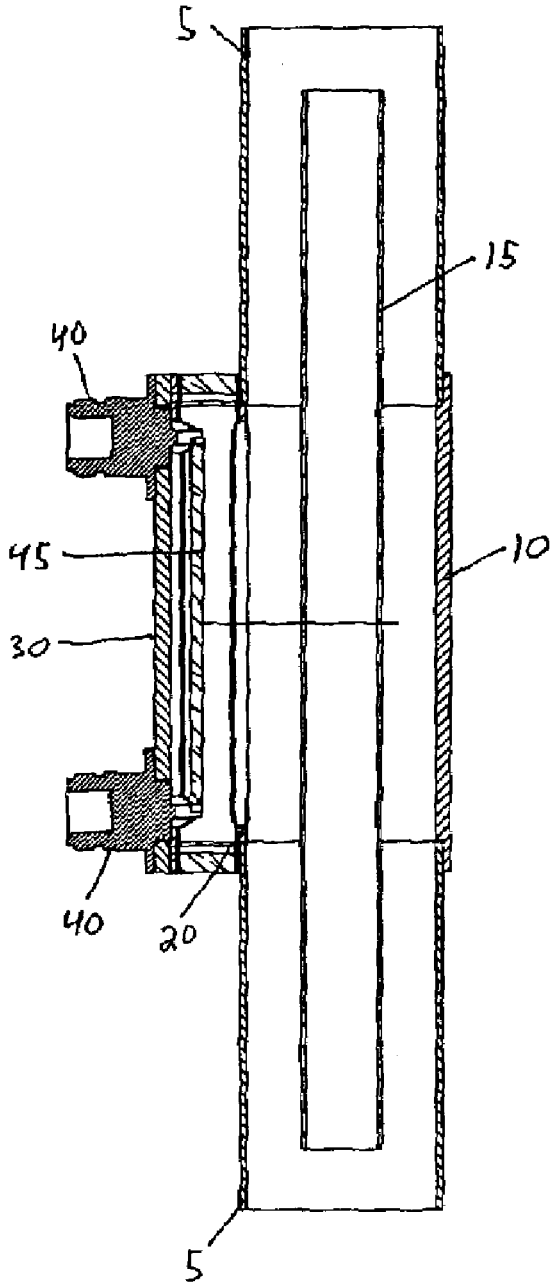
FIG. 10 is a cut-away side view, along the line AA, of FIG. 9.

In alternative embodiments, the aperture 20 may be opened or closed by, for example, an angular rather than linear adjustment. In a second embodiment, as shown in FIGS. 8–10 (similar elements are similarly labeled), the aperture 20 is opened or closed by surrounding the coupling conductor 45 with a slotted tube 60. The slotted tube 60 may be electrically sealed by end plug(s) 65. As the slotted tube 60 is rotated, the coupling conductor 45 may be variably isolated from or exposed to RF energy, thereby adjusting the coupling factor.

In this embodiment, rather than using connector slot(s) 70, the connection plate 30 has connection plate slot(s) 75 which allow the connection plate 30, connector(s) 40 and coupling conductor 45 to move laterally as a common assembly with respect to the slotted tube 60. This movement adjusts the position of the coupling conductor 45 with respect to the slotted tube 60, effectively changing the value of "Ca". This adjustment can be used to optimize the coupler directivity for a given coupling factor.

From the foregoing, it will be apparent that the present invention brings to the art a precision VCFDC 1 that does not require mechanical linkages or precision threading to obtain variations in coupling factor. The simplified apparatus is therefore cost effective to manufacture and less susceptible to mechanical wear.

| Table Heading | |
|---|---|
| 1 | variable coupling factor directional coupler |
| 5 | end |
| 10 | body |
| 15 | center conductor |
| 20 | aperture |
| 25 | gap plate |
| 30 | connection plate |
| 35 | groove |
| 40 | connector |
| 45 | coupling conductor |
| 50 | slot |
| 55 | load |
| 60 | slotted tube |
| 65 | end plugs |
| 70 | connector slot |
| 75 | connection plate slot |

Where in the foregoing description reference has been made to ratios, integers, components or modules having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

The invention claimed is:

1. A variable coupling factor directional coupler, comprising:

a body having an inner surface and an outer surface;

an elongated aperture in a side wall of the body extending from the outer surface of the body to the inner surface of the body;

a coupling conductor proximate the aperture; and a gap plate located between the body and the coupling conductor operable to cover a desired portion of the aperture.

2. The apparatus of claim 1, wherein the coupling conductor is movable only within a plane tangential to a longitudinal axis of the BODY.

3. The apparatus of claim 1, wherein the coupling conductor is connected at a first end to a center conductor of a first coaxial connector and at a second end to a center conductor of a second coaxial connector.

4. The apparatus of claim 3, wherein the first coaxial connector and the second coaxial connector are mounted to a connection plate connected to the body; the connection plate having a slot; the coupling conductor positioned in the slot.

5. The apparatus of claim 4, wherein a mounting position of the first coaxial connector and the second coaxial connector is adjustable via a plurality of connector slots.

6. The apparatus of claim 4, wherein a mounting position of the connection plate onto the body is adjustable via a connection plate slot.

7. The apparatus of claim 1, further including a first end connector connected to a first side at the body and a second end connector connected to a second side of the body.

8. The apparatus of claim 7, wherein the first end connector and the second end connector are adapted for interconnection with a one of a coaxial cable, a helically corrugated coaxial cable, and a waveguide.

9. The apparatus of claim 4, wherein the coupling conductor is adapted to be adjustable laterally with respect to a longitudinal axis of the body, within the slot.

10. A variable coupling factor directional coupler, comprising:

a body having a first side and a second side;

a first bore extending through the body from the first side to the second side;

a second bore extending through the body from the first side to the second side;

a slotted tube mounted within the second bore;

an elongated aperture interconnecting the first bore with the second bore; and a coupling conductor positioned within an internal area of the slotted tube; and the slotted tube rotatable to block the elongated aperture to a desired degree, thereby selectively isolating the coupling conductor from the first bore.

11. The apparatus of claim 10, wherein the coupling conductor is movable only within a plane tangential to a longitudinal axis of the first bore.

12. The apparatus of claim 10, wherein the coupling conductor is connected at a first end to a center conductor of a first coaxial connector and at a second end to a center conductor of a second coaxial connector.

13. The apparatus of claim 12, wherein the first coaxial connector and the second coaxial connector are mounted to a connection plate connected to the body; the coupling conductor spaced away from the connection plate to allow clearance for the slotted tube.

14. The apparatus of claim 12, wherein amounting position of the first coaxial connector and the second coaxial connector is adjustable via a plurality of connector slots.

15. The apparatus of claim 12, wherein a mounting position of a connection plate onto the body is adjustable via a connection plate slot.

16. The apparatus of claim 10, further including a first end connected to the body coaxial with the first bore on the first side and a second end connected to the body coaxial with the first bore on the second side.

17. The apparatus of claim 16, wherein the first end and the second end are adapted for interconnection with one of a coaxial cable, a helically corrugated coaxial cable, and a waveguide.

18. The apparatus of claim 10, wherein the coupling conductor is adapted to be adjustable laterally with respect to a longitudinal axis of the first bore, within the slotted tube.

19. The apparatus of claim 10, wherein a first end of the slotted tube is closed by a first end plug and a second end of the slotted tube is closed by a second end plug.

20. A method of varying a coupling factor between a transmission line and a coupling conductor, comprising the steps of:

positioning the coupling conductor proximate an aperture in extending through an outer conductor of the transmission line; and covering the aperture by planar movement of a gap plate to a degree providing a desired coupling factor.

21. The method of claim 20, wherein the coupling conductor is positioned within a slotted tube; and the aperture is covered by rotation of the slotted tube.

22. The method of claim 20, further including adjustment of coupling directivity by adjusting a lateral position of the coupling conductor within a plane tangential to a longitudinal axis of the transmission line.

* * * * *